US005392704A

United States Patent [19]

Silverberg et al.

[11] Patent Number: 5,392,704

[45] Date of Patent: Feb. 28, 1995

[54] MAILING MACHINE

[75] Inventors: Morton Silverberg, Westport; William A. Salancy, Norwalk; Steven A. Supron, Prospect, all of Conn.

[73] Assignee: Pitney Bowes Inc., Stamford, Conn.

[21] Appl. No.: 180,163

[22] Filed: Jan. 11, 1994

[51] Int. Cl.[6] ..... B41L 47/46

[52] U.S. Cl. ..... 101/92; 400/621; 400/613; 346/136; 235/101; 101/227

[58] Field of Search ..... 400/613, 613.1, 614, 400/617, 621; 101/91, 92, 93, 226, 227, 228; 226/11, 91, 92, 143; 235/101; 177/4, 145; 83/203, 509, 200; 364/464.2; 346/134, 136

[56] References Cited

U.S. PATENT DOCUMENTS

| | | | |
|---|---|---|---|
| 2,273,295 | 2/1942 | Strother et al. | 101/235 |
| 3,556,001 | 1/1971 | Kinney | 101/92 |
| 3,583,314 | 6/1971 | Gillender | 235/101 X |
| 3,749,013 | 7/1973 | Ellner | 101/277 |
| 3,791,293 | 2/1974 | Rostorguef et al. | 101/234 |
| 4,412,466 | 4/1983 | Jurkowstry | 83/200 |
| 4,580,144 | 4/1986 | Calvi | 235/101 X |
| 4,922,085 | 5/1990 | Dannett et al. | 235/101 |
| 4,957,179 | 9/1990 | Dannett | 101/91 X |
| 5,171,975 | 12/1992 | Lyga | 101/91 X |

*Primary Examiner*—Edgar S. Burr
*Assistant Examiner*—Christopher A. Bennett
*Attorney, Agent, or Firm*—Melvin J. Scolnick; David E. Pitchenik; Steven J. Shapiro

[57] ABSTRACT

A mailing machine is disclosed having an elongate feed deck, means for feeding envelopes along the feed deck, and a postage meter mounted in the mailing machine and having a printing mechanism disposed in juxtaposition with the feed deck so as to print postage indicia on successive envelopes as they are fed along the feed deck. The mailing machine includes a tape feeding and cutting apparatus mounted above the feed deck and adjacent to the postage meter on the side thereof opposite to the direction of feed of envelopes along the feed deck for feeding successive finite lengths of tape to the postage meter for printing of postage indicia on a portion thereof and for cutting and ejecting the printed portion of the finite length of tape from the mailing machine. The tape feeding and cutting apparatus is constructed and arranged so that all of the tape storing, feeding, severing and ejecting mechanisms of the apparatus are all positioned entirely one one side of the postage meter.

10 Claims, 8 Drawing Sheets

MAILING MACHINE

BACKGROUND OF THE INVENTION

The present invention relates generally to mailing machines having a postage meter which prints postage indicia on envelopes or tape, and more particularly to such mailing machines in which the tape handling mechanism is physically incorporated into a module mounted in one location in the mailing machine.

Prior art mailing machine have long been well known and have been widely accepted in all forms of commercial establishments from the largest of high volume mailers down to the smallest size businesses and professional offices. Broadly speaking, a mailing machine consists of a postage meter which prints postage indicia on an envelope or a strip of tape, and a feed base for feeding successive envelopes or a strip of tape past the postage meter, and ejecting either for further handling. Over the years, mailing machines have been available in a variety of sizes in terms of rate of operation and level of technical sophistication in terms of degree of automation, both commensurate with the type of establishment in which they are to be installed. Thus, for example, a machine found in the mailing room of a high-volume mailer such as a credit card billing office might process several thousand envelopes per hour, with automatic feeding, flap moistening, sealing and stacking. Similarly, a machine found in a small professional office might require manually feeding one envelope at a time into the feed base and do nothing more than print the postage indicia on the envelope and eject it.

Obviously, there are many variations between the extremes described above, and a large variety of machines have been designed and marketed to meet the mailing requirements of establishments whose mailing volume falls between these extremes. One important characteristic of machines falling in this category is that they have the capability of printing postage indicia either directly on envelopes as they are fed along a feed path through the mailing machine, or on a strip of tape, either gummed or adhesive backed, which is dispensed from the mailing machine for an operator to apply to an envelope which cannot be fed along the normal feed path to the printing device. This is a feature normally not incorporated into the smallest of mailing machines for the reason that the cost of tape feeding mechanisms would not be attractive to such low volume mailers that they would be willing to pay for a feature which would be used very infrequently.

Thus, the bulk of the development of tape feed mechanisms for mailing machines has been in the mid-range size, and particularly in machines in which it is anticipated that the user not only generates a fairly large volume of regular mail which can be automatically fed through the mailing machine, but also generates a substantial amount of mail which is either too large or too bulky to be fed through the mailing machine and therefore must have postage applied manually, either in the form of stamps or postage indicia printed on tape. Assuming that the user wishes to avoid the use of stamps, it becomes highly advantageous to incorporate a functionally efficient and cost effective tape handling and printing mechanism into the mailing machine.

While many successful machines incorporating tape printing capability have been designed and marketed, several disadvantages of including this feature have become apparent. Among the major drawbacks of these machines are that the structure for providing this capability has been relatively complex, has considerably increased the size of the mailing machines over what would be required without this feature, and has greatly added to the cost of the machines. Traditionally, the tape feed mechanism has been placed below the feed deck of the mailing machine so that the tape could be fed along the same path as an envelope through the printing device in the postage meter. This required providing room below the feed deck for a relatively large size roll of tape, and including the complex structure necessary to bring the tape up above the feed and through a guiding mechanism which guided the tape through the printing device and beyond. The physical space required for this mechanism resulted in the bases of prior art mailing machines being quite high, usually in the order of eight to ten inches. When the postage meter is added to that height, the end product tends to be rather bulky, difficult to service and not susceptible to good utilization of space in an otherwise crowded office or mail room.

Another disadvantage of prior art mailing machines is that when the tape is fed in the same direction through the mailing machine for cutting, printing, and ejection from the mailing machine, the piece of tape on which the postage indicia is printed is difficult to handle because a single piece of tape ranging from about 2 to 4 inches in length, depending on whether an advertising slogan is included with the postage indicia, must be moved through the printing device and beyond. Thus, the mailing machine must have relatively complex structure for physically handling a small strip of tape and feeding it to, through and beyond the postage meter printing device.

SUMMARY OF THE INVENTION

These and other problems and disadvantages of prior art mailing machines are at least obviated if not eliminated by the mailing machine of the present invention. In accordance with the principles of the present invention, a mailing machine has been designed in which all of the tape feeding, moistening, cutting and ejecting mechanism has been moved from beneath of the feed deck to a position above the feed deck, in the space necessarily created by the height of the adjacent postage meter and control panel, thereby making it possible to greatly reduce the height of the base and provide a generally less bulky, more space effective and more user friendly mailing machine. In addition, by providing a tape feed path in which the tape feeding, moistening, cutting and ejecting devices are on the same side of the postage meter, and by feeding the tape toward the postage meter for printing and then feeding it in the reverse direction for cutting, moistening and ejecting from the mailing machine, it is possible to handle the portion of the tape on which the postage indicia is printed while that portion is still connected to the tape web, thereby greatly simplifying the handling of the printed portion of the tape with less complex and less costly mechanism than has been heretofore required. Also, this arrangement of the aforementioned tape operating devices permits the entire tape handling apparatus to be constructed as a single self contained module which can be installed in and removed from the mailing machine to facilitate faster manufacturing, enhanced sales potential and improved service and maintenance.

With these broadly stated advantages in mind, the present invention is incorporated in a mailing machine having an elongate feed deck, means for feeding envelopes along the feed deck, and a postage meter mounted in the mailing machine and having a printing mechanism disposed in juxtaposition with the feed deck so as to print postage indicia on successive envelopes as they are fed along the feed deck. The invention is a tape feeding and cutting apparatus mounted in the mailing machine above the feed deck and adjacent to the postage meter on the side thereof opposite to the direction of feed of envelopes along the feed deck for feeding successive lengths of tape to the postage meter for printing of postage indicia on a portion thereof and for cutting and ejecting the printed portion of the finite lengths of tape from the mailing machine. The apparatus comprises means for storing a supply roll of tape of indefinite length, means defining a first predetermined feed path extending from the tape supply roll to the printing mechanism of the postage meter, and means defining a second predetermined feed path extending from a point on the first predetermined feed path away therefrom in a direction generally opposite to that in which the first predetermined feed path extends toward the printing mechanism. There is a means for feeding a finite length of tape from the tape supply roll along the first predetermined feed path to bring a portion of the finite length of tape to the printing mechanism of the postage meter for printing of a postage indicia on that portion of the finite length of tape. Finally, there is a means for severing only the printed portion of the finite length of tape and for ejecting the severed printing portion of the finite length of tape from the mailing machine along the second predetermined feed path, with the result that the means defining both the first and second tape feed paths and the tape storing, feeding, severing and ejecting means are all positioned entirely on one side of the postage meter.

Having briefly described the general nature of the present invention, it is a principle object thereof to provide a tape feeding and cutting apparatus for a mailing machine which facilitates a considerable reduction in the overall size of the mailing machine.

It is another object of the present invention to provide a tape feeding and cutting apparatus which is considerably simpler in construction and complexity than similar apparatus heretofore known, and therefore also considerably less costly and easier to maintain and service.

It is still another object of the present invention to provide a tape feeding and cutting apparatus maintains control over the portion of the tape on which the postage indicia is to be printed while it is fed to the postage meter, during printing and withdrawal from the printing mechanism, and positioning in the cutting device.

These and other objects and advantage of the present invention will become more apparent from an understanding of the following detailed description of a presently preferred embodiment of the invention, when considered in conjunction with the accompanying drawings.

DETAILED DESCRIPTION OF THE INVENTION

Figure 1:
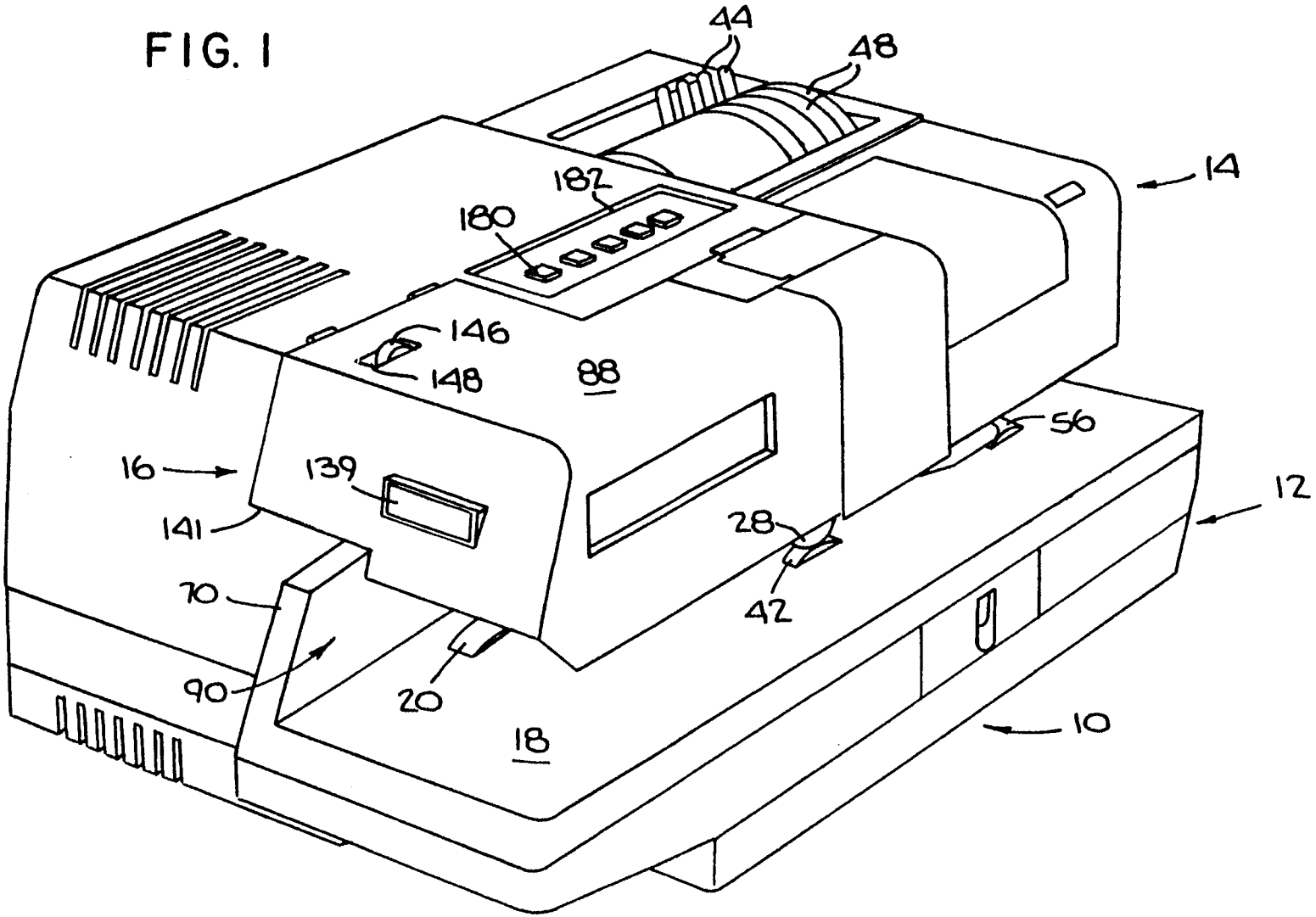
FIG. 1 is a general perspective view of a typical mailing machine embodying the principles of the present invention.
Figure 2:
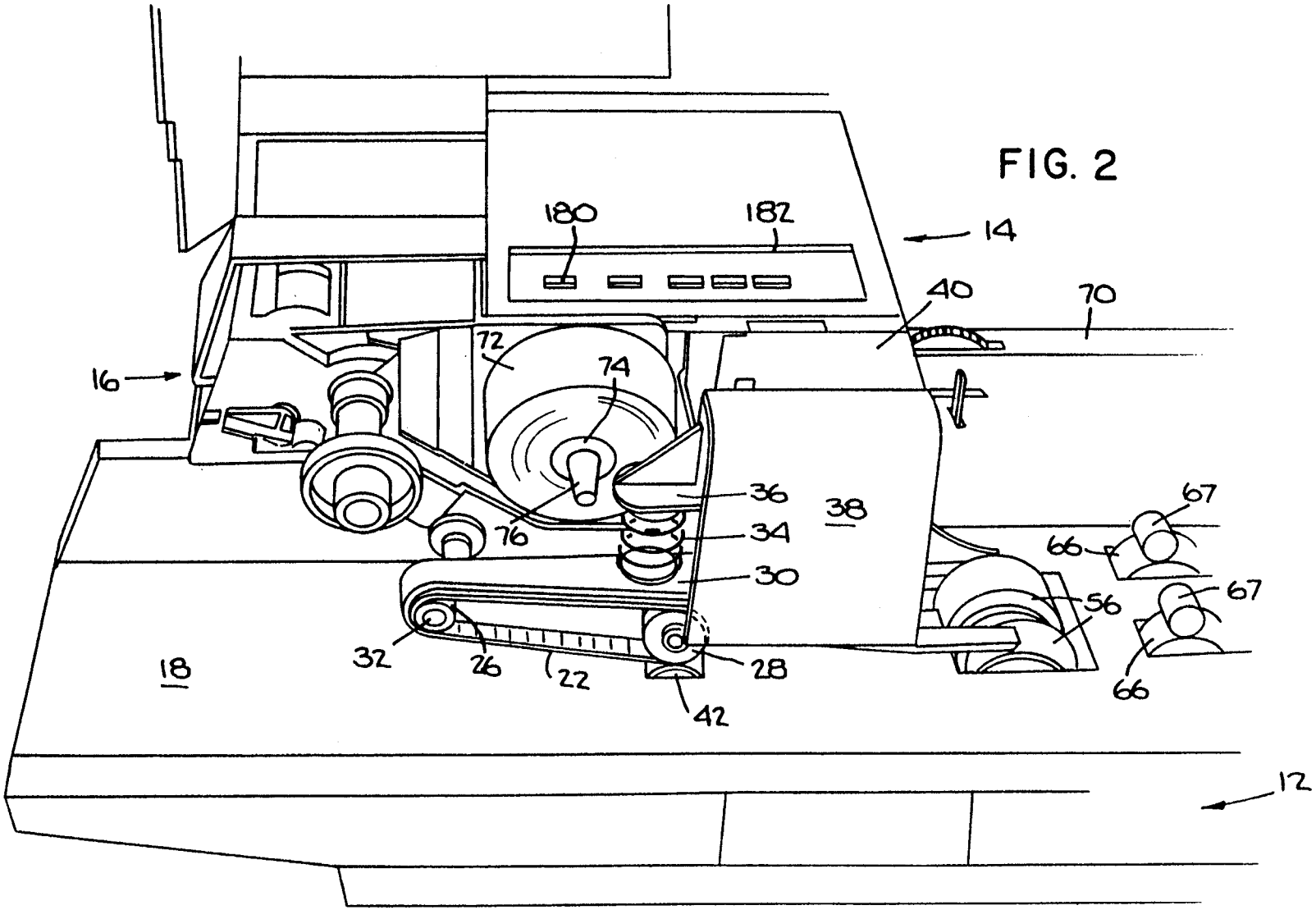
FIG. 2 is a frontal perspective view of the mailing machine shown in FIG. 1 with some covers and the postage meter removed to expose detail.

Referring now to the drawings and particularly to FIGS. 1 and 2 thereof, there is seen a mailing machine generally designated by the reference numeral 10, of the type above described which would be considered a mid-range sized mailing machine having the capability of printing postage indicia either on envelopes passing through the mailing machine or on gummed or adhesive backed tape for manual affixation to an envelope. The mailing machine 10 includes a base generally designated by the reference numeral 12, a postage meter, generally designated by the reference numeral 14, and a tape feeding and severing device generally designated by the reference numeral 16. It should be understood that, although mailing machines in general are highly complex in mechanical construction, the following description is simplified in the interest of brevity to include only so much structure of the mailing machine 10 and the base, postage meter and tape feed and severing subassemblies of the mailing machine as is necessary for an understanding of the present invention.

The base subassembly 12 includes a generally rectangular flat feed deck 18 which extends through the mailing machine 10 from one end to the other and serves to support envelopes and other mail pieces as they are fed through the mailing machine 10 in a left to right direction as the mailing machine is viewed in FIG. 1. The base 12 also includes feeding means such as one or more feed rollers 20 which project slightly above the surface of the feed deck 18 through suitable openings therein to engage the underside of envelopes as they move along the feed deck 18. The envelopes are fed to the postage meter 14 by a belt 22 which extends around a drive pulley 26 and an idler pulley 28 which engages the upper surface of the envelopes. The outer surface of the belt 22 passing around the idler pulley 28 is mounted on an elongate housing 30 which is pivoted about the shaft 32 which drives the drive pulley 26, and the housing 30 is spring loaded downwardly by the spring 34 captured between the upper surface of the elongate housing 30 and a suitable bracket 36 formed on a portion of the ink cartridge housing 38 which holds a removable ink cartridge 40. The idler pulley 28 engages an idler roller 42 mounted beneath the feed deck 18 which acts as a pressure backup to the idler pulley 28 to ensure proper feeding of the envelopes.

Figures 3, 4:
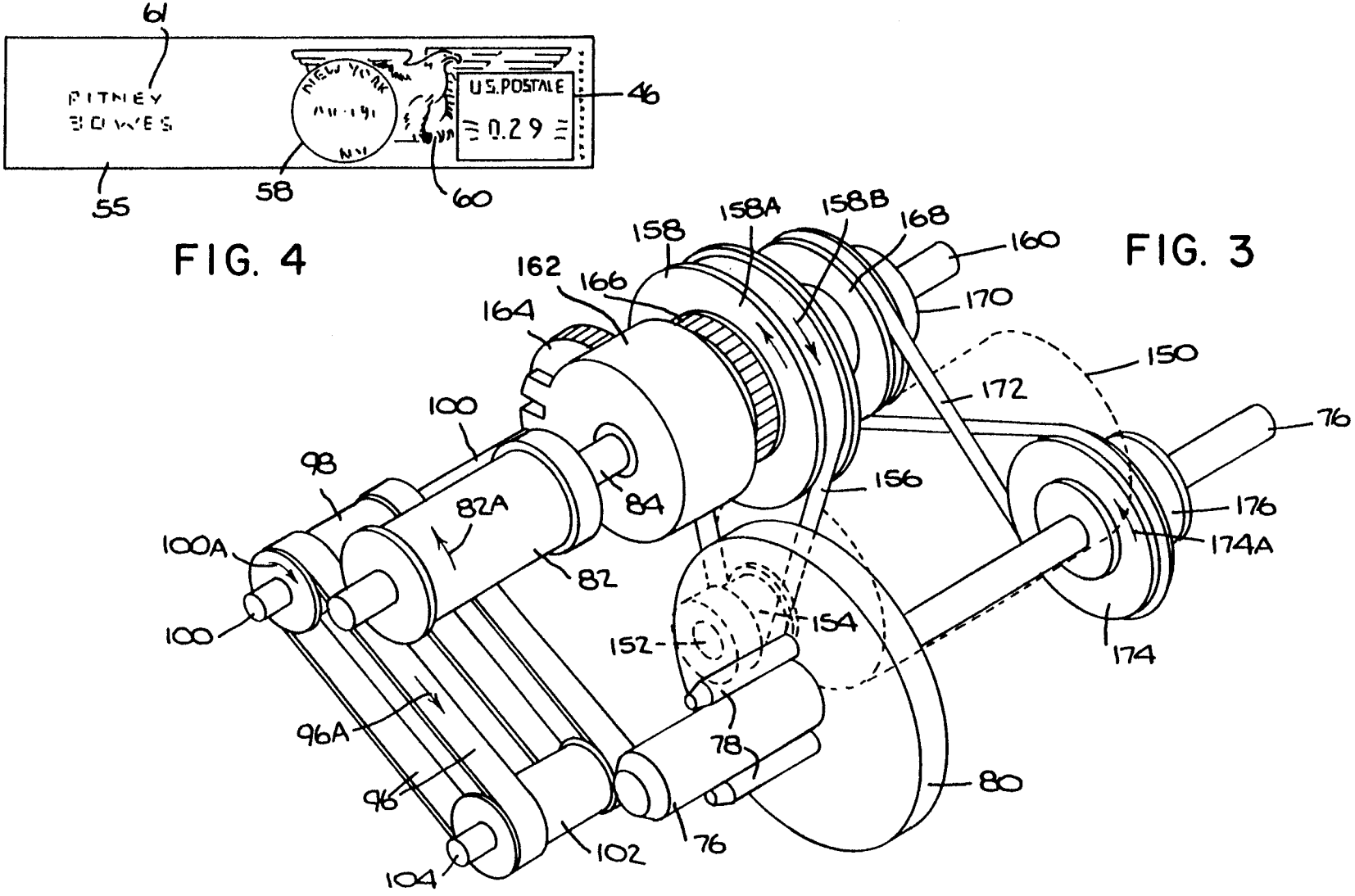
FIG. 3 is a perspective view of the drive mechanism for the apparatus of the present invention removed from the mailing machine to show necessary detail.
FIG. 4 is a view of the postage indicia printing on a portion of the tape, drawn to approximate actual size.

The postage meter 14 is suitably mounted on the base 10 adjacent to the downstream end of the feed deck 18 and is suitable latched in place. As best seen in FIGS. 1, 2, 5 and 6, the postage meter includes a plurality of setting levers 44 by which the amount of postage, seen as $0.29 in the postage rectangle 44 in the postage indicia shown in FIG. 4, is changed as needed, the levers 44 lining up with numerical indicia on the sliding scales 48. The postage meter 14 also includes a printing drum 50 mounted on a shaft 52 which is suitably driven to rotate in a counterclockwise direction as viewed in FIG. 5 and 6. The printing drum 50 carrier a printing die 54 which has the image of the postage indicia embossed thereon. The base includes a plurality of impression rollers 56 which engage the underside of envelopes passing thereover to press the envelopes into firm engagement with the printing die 54 so as to cause ink on the printing die 54 to be transferred to the upper surface of the envelope. FIG. 4 shows a representative postage indicia which is printed from the die 54, including the aforementioned postage rectangle 46, the city, state and date circle 58, the eagle graphics 60 and an advertising slogan 61. The postage meter 14 also includes an inking device consisting of an ink cartridge 62 rotatably mounted in the aforementioned ink cartridge holder 40 which contacts a spring loaded transfer roller 64 for transferring ink from the cartridge 62 to the image surface of the printing die 54 each time the printing drum 50 makes a revolution.

The base 12 further includes a plurality of eject rollers 66 and cooperating spring loaded pressure rollers 67 which engage the undersurface of the envelope as it exists from the nip of the printing die 54 and the impression rollers 56 to ensure that the envelope is conveyed to the end of the feed deck. 14.

Coming now to the essential features of the invention, and referring particularly to FIGS. 2, 3, 5 and 6, the tape feeding and severing device 16 is mounted on the base 12 generally adjacent to the upstream end of the feed deck 18. The base includes an upstanding wall 70 which extends along the length of the feed deck 18 and forms a registration wall for envelopes moving along the feed deck. The wall 70 is also a structural member of the mailing machine on which the components of the tape feeding and severing device 16 are mounted. Thus, the tape feeding and severing device 16 includes a roll of tape 72 mounted on a spindle 74 which in turn is mounted on a shaft 76 rotatably mounted on the wall 70. A pair of pins 78 (FIG. 3) are fixed to a disk 80 mounted on the shaft 76, the pins 78 fitting into suitable holes in the tape spindle 74 to form a driving engagement between the shaft 76 and the tape spindle 74 so that tape spindles can be readily installed and removed from the shaft 76 as tape needs to be replenished. The disk 80 forms a backup for the rolls of tape to properly align the tape with the feeding and guiding parts yet to be described.

Tape from the roll 72 is drawn off from the bottom of the roll and is passed over a feed roller 82 which is mounted on a drive shaft 84 rotatably mounted in suitable bearings in the wall 70. A guide plate 86 mounted on the wall 70 is formed to have a circular portion thereof pass partly around the feed roller to maintain the tape in close proximity thereto, and a curved portion extending from the circular portion to a point adjacent the tape roll 72 to prevent tape from forming a reverse loop between the normal path of the tape and the top wall 88 of a housing generally designated by the numeral 90 in FIG. 1. An idler roller 92 is rotatably mounted on one leg 93 of a yoke 95 which is pivotally mounted on the shaft 97 which is mounted on the wall 70. The leg 93 of the yoke 95 is suitably connected to the plunger 99 of a solenoid S mounted on the rear face of the wall 70. By successively energizing and de-energizing the solenoid S, the idler roller 94 is moved toward and away from the feed roller 82, thereby successively pressing the tape into feeding relationship with the feed roller 82 and releasing the tape therefrom, so that when the feed roller 82 rotates in either direction it will feed the tape in either direction, or allow the tape to be pulled freely over the feed roller 82, as more fully explained hereinafter.

After passing between the feed roller 82 and the idler roller 92, the tape passes through a cutting mechanism generally designated by the reference numeral 94 in FIGS. 5 and 6, and more fully described hereinbelow in connection with FIGS. 7 through 9. After exiting the cutting mechanism 94, the tape passes between a pair of parallel drive belts (FIG. 3) which are carried at one end by a driving roller 98 mounted on a shaft 100, which is driven in a manner described hereinbelow. The other end of the belts 96 pass around an idler roller 102 rotatably mounted on a shaft 104 mounted on the wall 70. The shafts 100 and 104 are mounted on the wall 70 such that the upper runs of the belts 96 pass closely adjacent to the cutting mechanism 94. A pair of spring loaded star wheels 106, one for each belt 96, are mounted on a shaft 108 which is mounted on the other leg 109 of the yoke 95 in overlying relationship to the shaft 104 and are moved toward and away from the belts 96 in synchronism with the similar movement of the idler roller 92 on the other leg 93 of the yoke 95. Thus, the idler roller 92 and the star wheels 106 are both in or out of driving engagement with the tape at the same time depending on whether the solenoid S is energized or de-energized. Another pair of spring loaded star wheels 110 is mounted on a shaft 112 which overlies the shaft 100 and which are also urged toward the belts 96 for the same purpose. As will be more clear from the description of operation of the mailing machine set forth hereinbelow, the belts 96 and pairs of star wheels 106 and 110 only contact the tape adjacent the edge thereof so as to avoid smearing any of the ink on the printed indicia.

An elongate tape track 114 is suitably mounted to extend from a point closely adjacent to the nip of the belts 96 and star wheels 106 to another point closely adjacent to the nip of the postage meter drum 50 and the impression roller 56. The tape track 114 guides the tape over an otherwise unsupported span from the feed belts 96 to the postage meter 14 so that when the tape is being fed by the feed roller 82 and the belts 96 and star wheels 106 and 110, the lead edge of the tape will be properly guided to the printing drum 50 and impression roller 56 of the postage meter. Thus, the distance from the tape supply roll 72 to the end of the tape track 114 and the mechanism therebetween constitute a first predetermined feed path along which the tape is fed.

Figure 7:
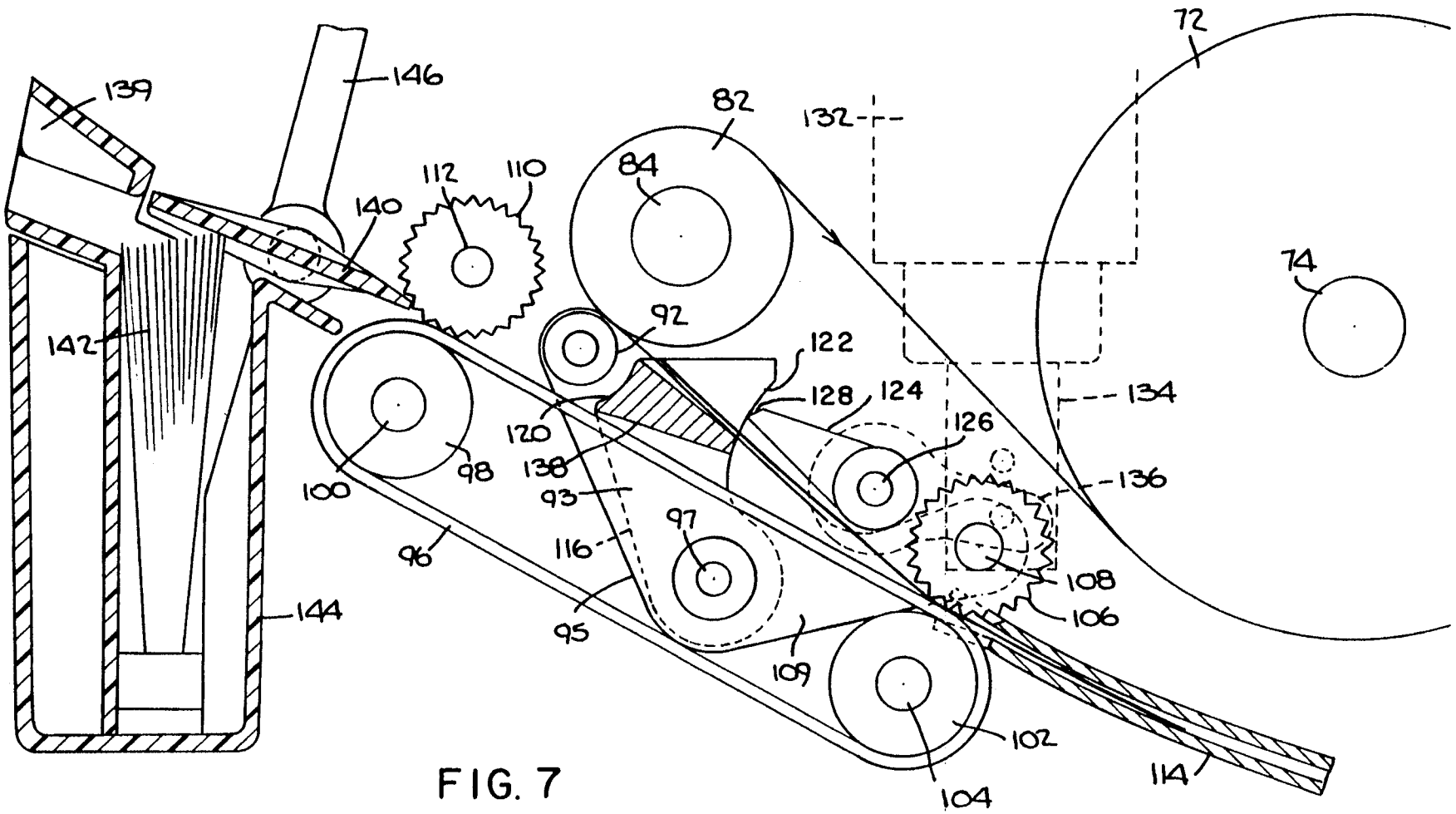
FIG. 7 is a view similar to FIGS. 5 and 6, drawing to a further enlarged scale, showing the tape being fed in the reverse direction through the cutting device after the postage indicia has been printed thereon by the printing mechanism of the postage meter.
Figure 8:
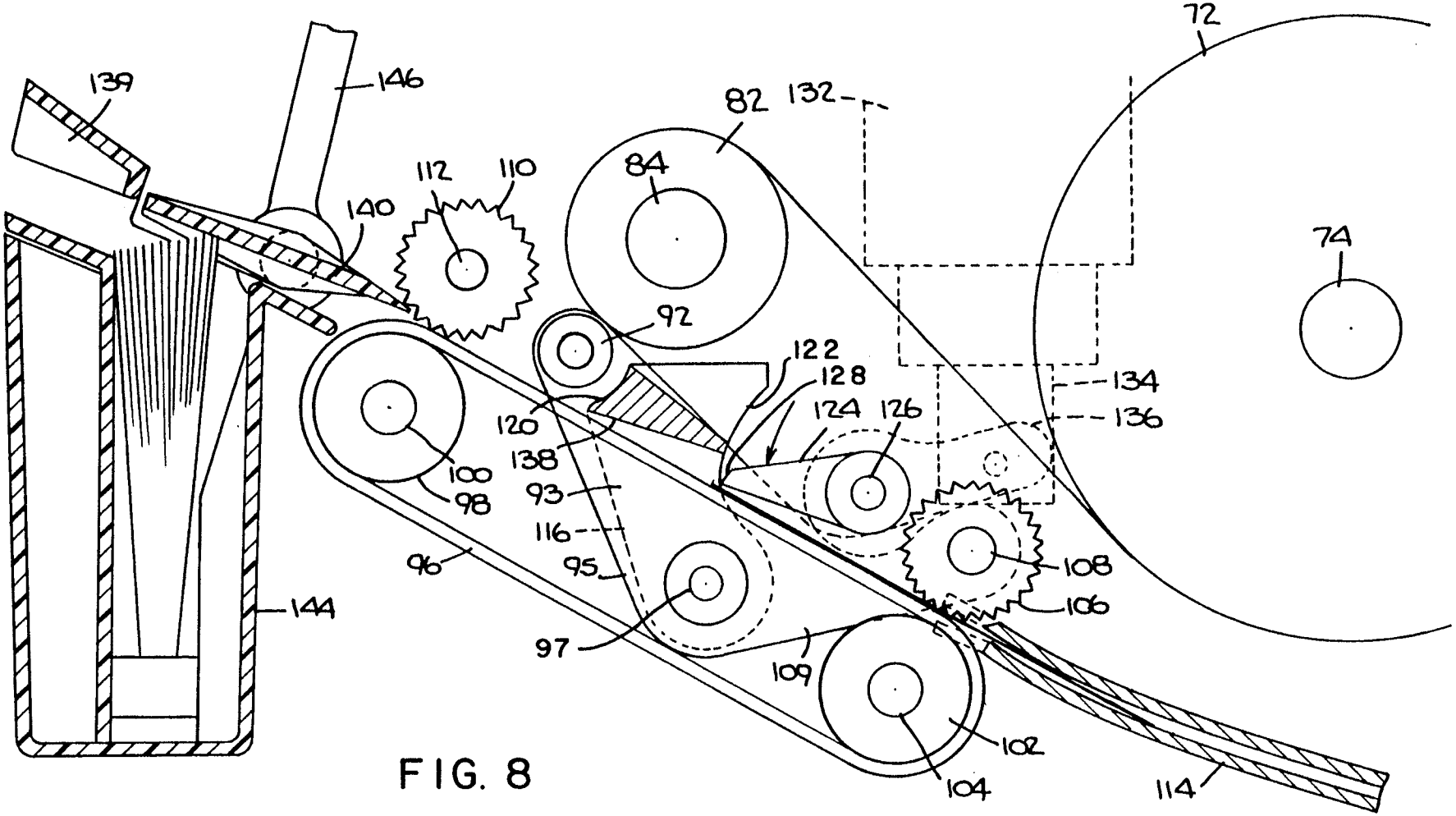
FIG. 8 is a view similar to FIG. 7 but showing the printed portion of the tape having been severed and about to be ejected from the mailing machine.
Figure 9:
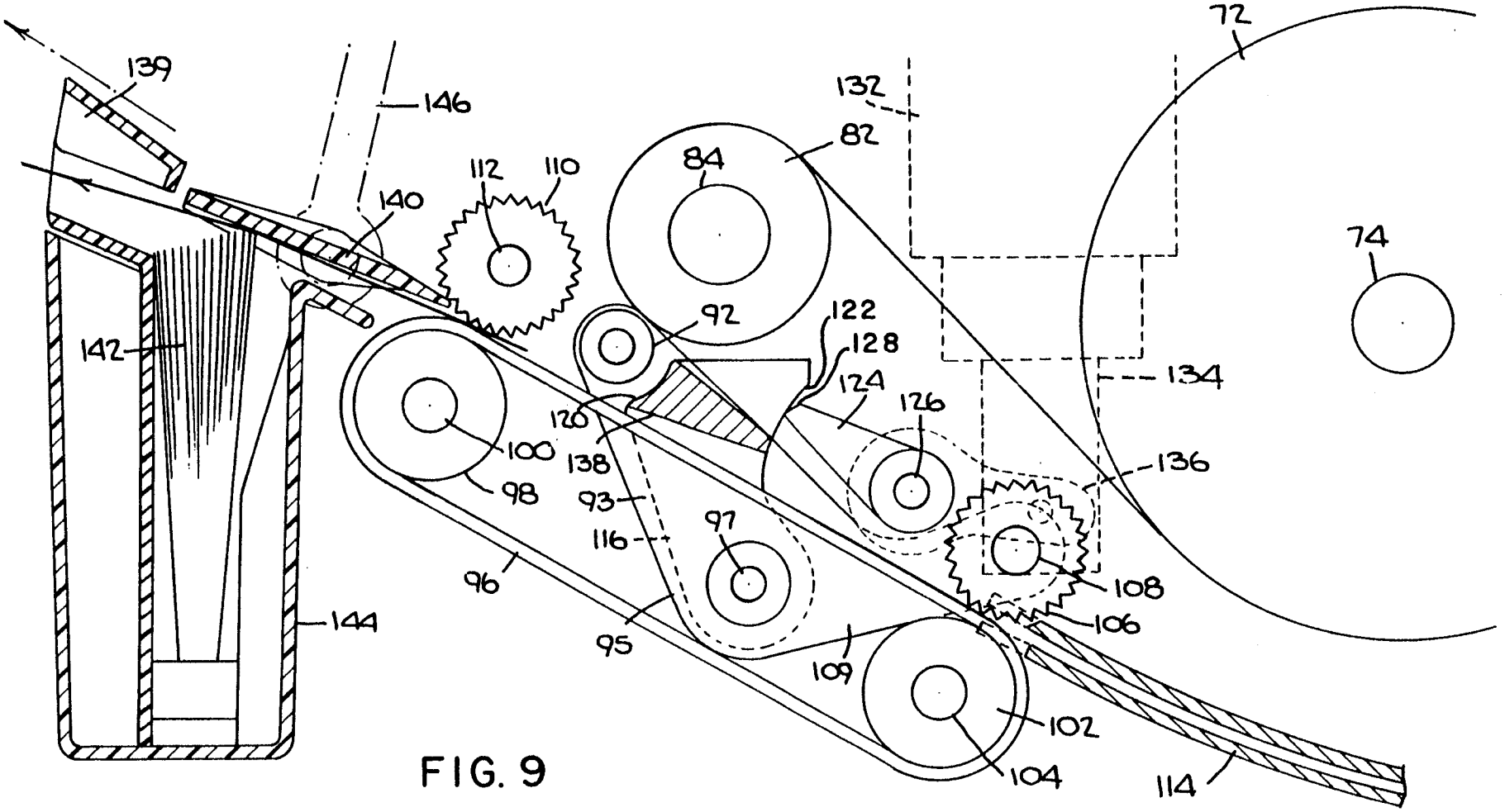
FIG. 9 is a view similar to FIGS. 7 and 8 but showing the severed portion of the tape being transported out of the housing.

Referring now to FIGS. 7 through 9, the aforementioned cutting mechanism 94 is seen to comprise a pair of generally upstanding arms 116 (only one shown)

mounted on the same shaft 97 that the yoke 95 is mounted on, the arms supporting a cross member 120 over which the tape passes. The downstream edge 122 of the cross member forms an anvil or cutting edge for the tape. A cutting arm 124, against which the upstanding arms 116 are urged by suitable spring means, is rotatably mounted on a shaft 126 secured to the wall 70, the cutting arm 124 having a beveled cutting edge or blade 128 which cooperates with the cutting edge 122 on the cross member 120 when the cutting arm 124 is rotated in a counter clockwise direction, as shown by the arrow 130 in FIG. 8. The cutting arm 124 is suitably rotated by a solenoid 132 having a plunger 134 connected to an extension 136 of the cutter arm 124 which projects from the shaft 126 in the opposite direction from the cutter arm 124, so that when the plunger 134 is retracted into the solenoid 132, the cutter arm is rotated as aforesaid, thereby severing the portion of tape projecting outwardly beyond the cutting edge 122.

The lower surface 138 of the cross member 122 is spaced closely adjacent to the upper runs of the belts 96 so as to form an exit channel for the severed portion of the tape when the belts 96 are run in a reverse direction as fully described below. As best seen in FIG. 8, after the tape is severed by the cooperating cutting edges 122 and 124, the now leading edge of the severed piece of tape is pushed downwardly onto the belts 96, and the trailing edge then becomes the lead edge of the severed strip after the belts 96 are reversed and the severed strip is transported out of the cutting mechanism and an outlet 139 in the side wall 141 of the housing 90, as shown in FIG. 9. A deflector 140 is pivotally mounted on the wall 70 so as to guide the severed strip of tape either under the deflector 140 to cause the strip of tape of wipe across the bristles 142 of a moistening device 144 so as to moisten the lower surface of the severed strip for immediate application to an envelope, or over the deflector 140 to prevent the severed strip of tape from being moistened. The deflector is operated by a suitable lever 146 which projects through an opening 148 in the top wall 88 of the housing 90 to be accessible to an operator. The distance from the cutting edge 122 to the tape outlet 139 and the mechanism therebetween constitute a second predetermined feed path which extends away from the first predetermined feed path in a generally opposite direction from that in which tape is fed along the first predetermined feed path.

The drive mechanism for operating the tape feed and cutting mechanism as above described can best be understood with reference again to FIG. 3. A suitable DC reversing motor has a drive shaft 152 on which is mounted a pulley 154 which drives a belt 156 which in turn drives a pulley 158 mounted on a shaft 160. The shaft 160 is connected to the aforementioned drive shaft 84 through an electromagnetic friction clutch 162 which, when energized, provides a direct connection between the shafts 160 and 84,so that rotation of the pulley 158 will drive both shafts in the same direction. As previously mentioned, rotating the shaft 84 also rotates the feed roller 82 to feed tape from the supply roll 72 to the cutting mechanism 94. The shaft 100 has a gear 164 mounted thereon which is in engagement with another gear 166 also mounted on the shaft 160, so that when the shaft 160 is being driven in one direction, the shaft 100 is being driven in the opposite direction through the gears 166 and 164. Another pulley 168 is mounted on the shaft 160, but through a one way clutch 170 so that the pulley 168 is driven in only one direction of rotation of the shaft 160. A belt 172 extends around the pulley 168 and is crossed intermediate the pulley 168 and another pulley 174 mounted on the shaft 76 through another friction clutch 176, so that the shaft 76 is driven by the belt 172 and pulley 174 only to the extent that it exceeds a resisting torque imposed on the shaft 76 as further explained below.

A complete cycle of operation of the foregoing structure will now be set forth with principal reference to FIG. 3 and secondary reference to the other views; and in view of the relative complexity of the apparatus, the description of the operation is broken down into separate parts headed Tape Feed, Imprint, Retract, Cut and Divert, and Eject.

TAPE FEED

A cycle of operation is initiated by the operator pushing a start button 180 located on a suitable control panel 182 seen on the top of the mailing machine in FIG. 1. This energizes the motor 150 to rotate the motor shaft 152 in a counter clockwise direction, thereby rotating the pulley 154 in the same direction to move the belt 156 to rotate the pulley 158 in a counter clockwise direction, as indicated by the arrow 158A. The pulley 158 rotates the shaft 160 in the same direction. At this time, as controlled by a suitable microprocessor in the mailing machine, the details of which form no part of the invention and are therefore not further described, the solenoid S is deenergized so that the yoke 95 is in its clockwise position as shown in FIG. 5 with the idler roller 92 pressing the tape into driving engagement with the feed drum 82, and the star wheels 106 pressing the tape into driving engagement with the belts 96. Also, the electro-magnetic clutch 162 is energized so that the shaft 160 and the shaft 84 are in driving engagement with each other through the clutch 162 so that the shaft 84 and the tape feed roller 82 are both driven in a counter clockwise direction as indicated by the arrow 82A. Simultaneously, the shaft 100 is rotated through the gears 166 and 164 in a clockwise direction, as indicated by the arrow 108A, thereby moving the belts 96 in the direction of the arrow 96A on the upper run of the outermost belt.

With these parts in motion, the tape, the leading edge of which is normally disposed at the cutting edge 122, is now fed from the supply roll 72 through the cutting mechanism 94 and into the nip of the belts 96 and star rollers 106, and from there into and through the tape track 114, as best seen in FIG. 7. While tape is being fed in this direction, the one way clutch 170 prevents drive from being transmitted from the shaft 160 to the pulley 168, thereby permitting the shaft 76 to rotate in a clockwise direction, as indicated by the arrow 72A in FIG. 5, as tape is withdrawn from the lower side of the tape spool 72.

IMPRINT

The tape is fed in this manner until the lead edge thereof reaches the the nip of the printing die 54 and the impression roller 56. At the instant that this occurs, as detected by a suitable sensor (not shown), the microprocessor deenergizes the motor 150 to stop rotation of the motor shaft 152, deenergizes the clutch 162 to cause it to disengage, thereby allowing the tape feed roller 82 to rotate freely, and energizes the solenoid S to cause the yoke 95 to pivot to the counter clockwise position shown in FIG. 6 in which the idler roller 92 is moved away from the feed roller 82 and the star wheels 106 are moved away from the belts 96 so that the tape is free to slide past these rollers in response to being pulled through the tape feed mechanism by the printing drum 50 and the impression roller 56 of the postage meter. The printing operation is completed when the printing drum 50 has rotated sufficiently far to bring the end of the printing die 54, whatever its length may be, to the printing position at the impression roller 56, where the tape is no longer gripped by the printing die and the impression roller 56 and is therefore free to move in the reverse direction. Thus, with the initial feeding of the tape by the mechanism described in the preceding section, combined with the additional feeding of the tape by the printing die, a finite length of tape is fed which includes the portion thereof on which the postage indicia and/or advertising slogan are printed.

RETRACT

Figure 5:
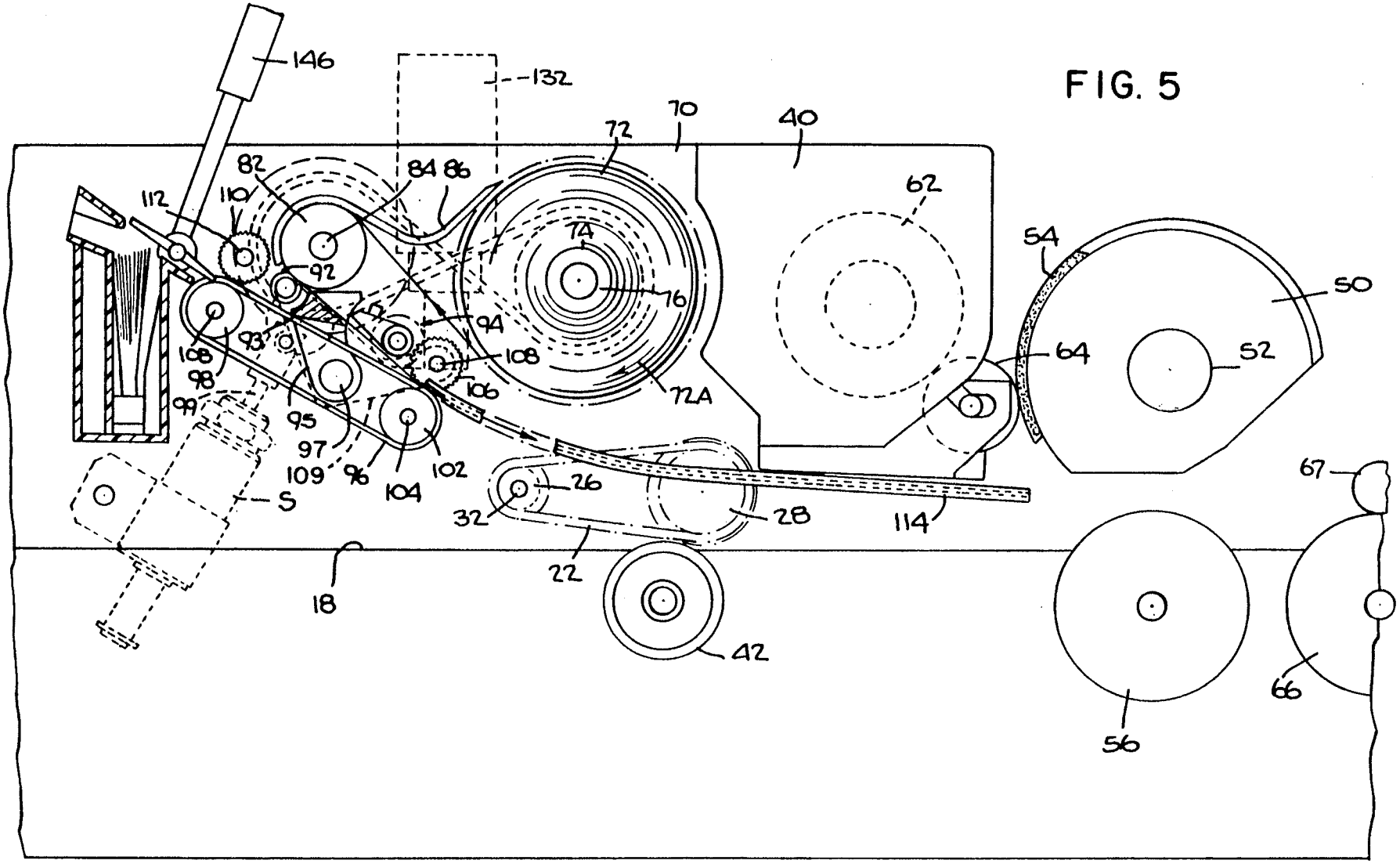
FIG. 5 is a front view, drawn to a slightly enlarged scale, of the tape storing, feeding and cutting mechanism of the present invention.
Figure 6:
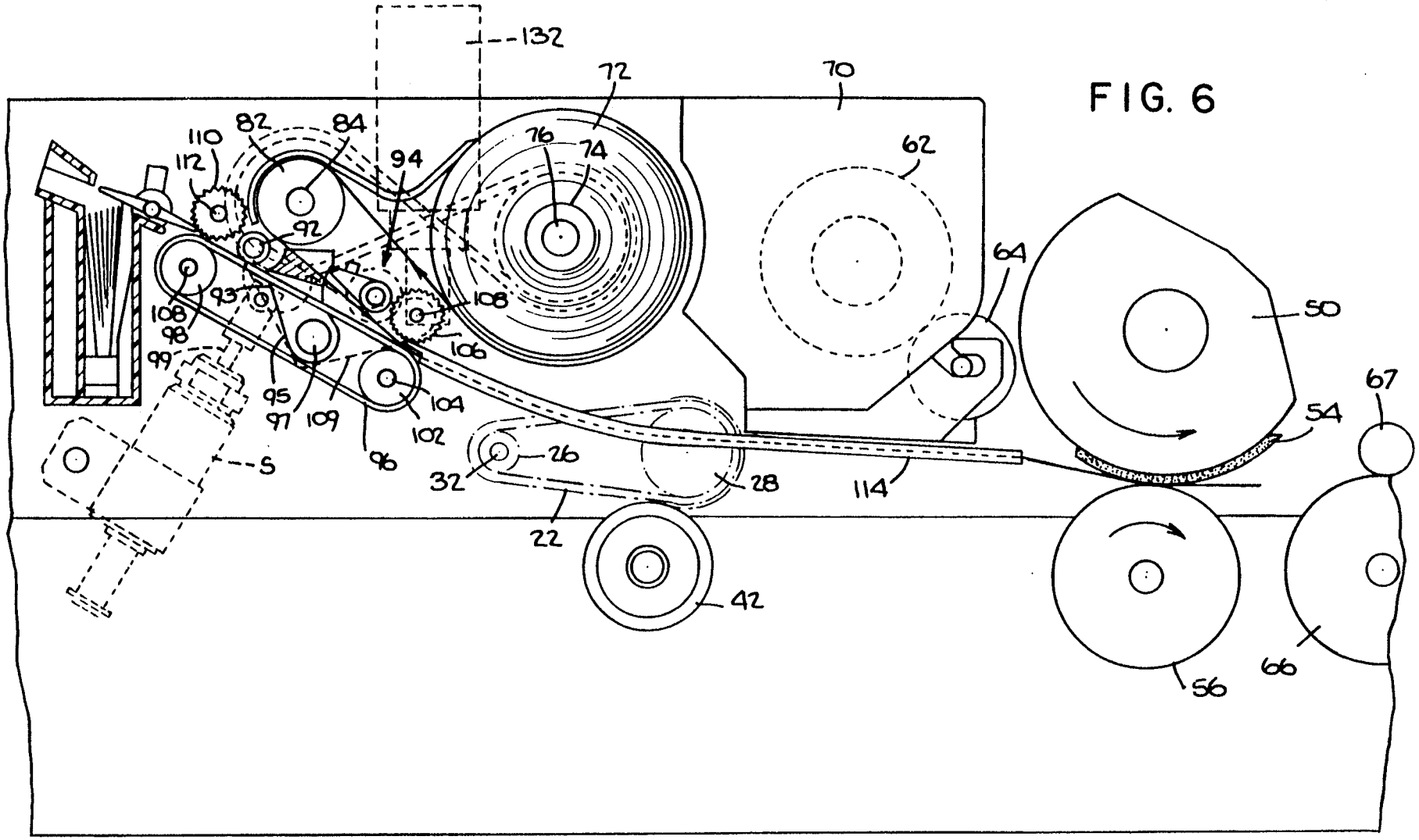
FIG. 6 is a view similar to FIG. 5 but showing the tape strip extending into the printing mechanism of the postage meter.

The microprocessor now energizes the motor 150 to cause the motor shaft 152 to rotate in the opposite direction, reenergizes the electromagnetic clutch 162 to again connect the shafts 84 and 100 to the motor shaft 152, and also deenergizes the solenoid S to pivot the yoke back to the clockwise position shown in FIG. 5 so that the idler roller 92 and the star wheels 106 again press the tape into feeding engagement with the feed roller 82 and the belts 96 respectively. As a result, the feed roller 82 and the belts 96 feed the tape in the reverse direction, i.e., away from the postage meter printing drum 50. At the same time, the motor 150 now drives the pulley 158 in a clockwise direction as indicated by the arrow 158B, which in turn drives the shaft 160 in the same direction. The drive from the shaft 160 is now transmitted through the one way clutch 170 to drive the pulley 168 in a clockwise direction, which in turn drives the pulley 174 in a counter clockwise direction as indicated by the arrow 174A. The drive from the pulley 174 is transmitted through the slip clutch 176 to rotate the shaft 76 in the counter clockwise direction, which rotates the spool of tape 72 in the same direction thereby winding tape back on to the spool during the reverse direction movement of the tape. The amount of tape which is fed in the reverse direction is fixed, being the distance from the point of last printing, i.e., where the end of the printing die 54 is adjacent the impression roller 56, back to the location of the cutting edge 122, less any desired amount of margin between the end of the printed indicia and the edge of the printed portion of tape. Thus, with the initial feeding of the tape by the mechanism described in the preceding section combined with the additional feeding of the tape by the printing die 54 and the impression roller 56, a finite length of tape is fed from the supply roll 72 which includes the portion thereof on which the postage indicia and/or advertising slogan is/are printed.

CUT and DIVERT

The microprocessor knows the fixed amount of tape that must be fed in the reverse direction to move the printed portion of the tape out of the printing device of the postage meter and to bring the new lead edge of the printed portion into the cutting device 94. When this condition is reached, the microprocessor deenergizes the motor 150 to stop rotation of the motor shaft 152 and deenergizes the electromagnetic clutch 162, thereby terminating drive to the feed roller 82, the tape spool 72 and the belts 96. The microprocessor then energizes the solenoid 132 to cause the movable knife blade 124 to rotate downwardly, thereby severing the tape and depressing the severed edge onto the upper surface of the belts 96, as seen in FIG. 8.

EJECT and END OF CYCLE

As soon as the knife blade 124 severs the tape, the motor 150 is reenergized by the microprocessor to cause the motor shaft 152 to again commence rotation in the reverse or clockwise direction so as to restart the drive to the belts 96 through the gears 164 and 166 and the shaft 100. At this time and for the remainder of the cycle, the electromagnetic clutch 162 remains deenergized, thereby preventing the tape from being rewound onto the tape spool 72. Since the star wheels 106 are still in contact with the severed portion of tape on the belts 96, the severed portion of tape will be fed in the reverse direction toward the star wheels 110, which will continue to feed the severed portion of tape over the bristles 142 of the moistening device 144, or bypassing the moistening device 144 depending on the position of the deflector 140. When the severed portion of tape has reached a predetermined exit position, the microprocessor deenergizes the solenoid 132, allowing the movable knife blade 124 to return to its normal position, and deenergizes the motor 150 to terminate drive to the belts 96. At this point, all parts of the apparatus are in their normal portions or static conditions, and the apparatus is ready for another cycle of operation.

It is to be understood that the present invention is not to be considered as limited to the specific embodiment described above and shown in the accompanying drawings, which is merely illustrative of the best mode presently contemplated for carrying out the invention and which is susceptible to such changes as may be obvious to one skilled in the art, but rather that the invention is intended to cover all such variations, modifications and equivalents thereof as may be deemed to be within the scope of the claims appended hereto.

We claim:

1. In a mailing machine having an elongate feed deck, means for feeding envelopes along the feed deck, and a postage meter mounted in the mailing machine and having a printing mechanism disposed in juxtaposition with the feed deck so as to print postage indicia on successive envelopes as they are fed along the feed deck, a tape feeding and cutting apparatus mounted in the mailing machine above the feed deck and adjacent to the postage meter on the upstream side thereof with respect to the direction of feed of the envelopes along the feed deck for feeding successive lengths of tape to the postage meter for printing of postage indicia on a portion thereof and for cutting and ejecting the printed portion of finite lengths of tape from the mailing machine, said apparatus comprising:

A. means for storing a supply roll of tape of indefinite length,

B. means for defining a first predetermined feed path extending from said tape supply roll to the printing mechanism of the postage meter, C. means defining a second predetermined feed path extending from a point on said first predetermined feed path away therefrom in a direction generally opposite to that in which said first predetermined feed path extends toward said printing mechanism, D. means for feeding a finite length of tape from said tape supply roll along said first predetermined feed path to bring a portion of said finite length of tape to the printing mechanism of the postage meter for printing of a postage indicia on said portion of said finite length of tape, E. means for severing said printed portion of said finite length of tape, and F. means for ejecting said severed printed portion of said finite length of tape from the mailing machine along said second predetermined feed path, whereby said means for defining said first and second predetermined feed paths and said tape storing, feeding severing and ejecting means are all positioned entirely on one side of the postage meter.

2. An apparatus as set forth in claim 1 wherein said feeding means comprises a first pair of cooperating feed elements and a second pair of cooperating feed elements spaced from said first pair of cooperating feed elements, both of said pairs of cooperating feed elements being disposed along said first predetermined feed path.

3. An apparatus as set forth in claim 2 wherein said severing means is disposed along said first predetermined feed path intermediate said first and second pairs of cooperating feed elements.

4. An apparatus as set forth in claim 3 wherein said severing means is disposed along said first predetermined feed path sufficiently far from said postage meter printing mechanism that said finite length of tape fed along said first predetermined feed path is substantially longer than said portion of said finite length on which the postage indicia is printed.

5. An apparatus as set forth in claim 4 wherein said severing means defines the juncture of said first and second predetermined feed paths.

6. An apparatus as set forth in claim 5 wherein said severing means includes means for directing the leading edge of said severed printed portion of said finite length of tape from said first predetermined feed path to said second predetermined feed path whereby further movement of said severed printed portion will be along said second predetermined feed path.

7. An apparatus as set forth in claim 6 wherein said ejecting means comprises a first pair of cooperating feed elements disposed along said first predetermined feed path on the side of said severing means closer to said postage meter printing device, and a second pair of cooperating feed elements disposed along said second predetermined feed path on the opposite side of said severing means from said first pair of cooperating feed elements.

8. An apparatus as set forth in claim 7 wherein said second pair of cooperating feed elements of said feeding means and said first pair of cooperating feed elements of said ejecting means are defined by the same structure.

9. An apparatus as set forth in claim 8 wherein at least one of said cooperating feed elements of both of said first and second pairs of cooperating feed elements of said electing means and said first and second pairs of cooperating feed elements of said feeding means comprises an endless belt which spans the distance between respective ones of said first and second pairs of cooperating feed elements, said belt being disposed adjacent to said severing means in position to have said leading edge of said severed portion of said tape placed in contact with said belt by said severing means.

10. An apparatus as set forth in claim 1 further including control means for sequentially A. causing said feeding means to feed a portion of said finite length of tape along said first predetermined feed path until the leading edge thereof reaches said postage meter printing device, B. causing said feeding means to release the tape to allow the postage meter printing device to feed said portion of said finite length on which the postage indicia is printed along said first predetermined feed path and through the postage meter printing device until the printing of the postage indicia is completed, C. causing said feeding means to reengage the tape and to feed the tape along said first predetermined feed path in a direction opposite to that in which it was initially fed to the postage meter printing device, D. causing said feeding means to stop the movement of said tape when the leading edge of the printed portion of the tape is adjacent said severing means, E. causing said severing means to sever said tape and to direct the leading edge of the severed portion of said finite length to said second predetermined feed path, F. causing said feeding means and said ejecting means to resume movement of said severed portion of said tape in said opposite direction, and G. causing said ejecting means to eject the severed printed portion of said finite length of tape along said second predetermined feed path from the mailing machine.

* * * * *